United States Patent [19]

Gerstmann et al.

[11] Patent Number: 5,033,957

[45] Date of Patent: Jul. 23, 1991

[54] VAPORIZING DIESEL BURNER

[75] Inventors: Joseph Gerstmann, Framingham; Elia P. Demetri, Woburn; Jordan N. Jacobs, Randolph; Donald W. Pickard, Sherborn, all of Mass.

[73] Assignee: Advanced Mechanical Technology, Inc., Newton, Mass.

[21] Appl. No.: 396,542

[22] Filed: Aug. 21, 1989

[51] Int. Cl.[5] ..... F23D 11/38; F23D 11/44; F23D 14/50

[52] U.S. Cl. ..... 431/123; 431/236; 431/237; 431/243

[58] Field of Search ..... 431/32, 3, 230, 233, 431/235, 236, 237, 41, 75, 77, 354, 326, 121, 119, 123, 207, 218, 222, 226, 227, 232, 243, 244, 247

[56] References Cited

U.S. PATENT DOCUMENTS

| | | | |
|---|---|---|---|
| 664,178 | 2/1900 | Kirkpatric | 431/247 |
| 731,800 | 6/1903 | Macklin | 431/104 |
| 740,472 | 10/1903 | Ruby | 431/232 |
| 768,642 | 8/1904 | Tones | 431/104 |
| 886,103 | 4/1908 | White | 431/232 |
| 1,003,329 | 9/1911 | Burton | 431/104 |
| 1,061,382 | 5/1913 | Huber | 431/235 |
| 1,140,405 | 5/1915 | Seitz | 431/235 |
| 1,317,448 | 9/1919 | Irving et al. | 431/244 |
| 1,338,361 | 4/1920 | Doran | 431/232 |
| 1,780,783 | 11/1930 | Leety et al. | 431/119 |
| 2,491,430 | 12/1949 | Tullis | 431/232 |

FOREIGN PATENT DOCUMENTS

| | | | |
|---|---|---|---|
| 57607 | 5/1940 | Denmark | 431/123 |
| 36816 | 8/1912 | Fed. Rep. of Germany | 431/123 |
| 806128 | 7/1947 | Fed. Rep. of Germany | 431/123 |

OTHER PUBLICATIONS

MSR Stove System Instruction Manual, No date given.
Optimus 199-Ranger Manual, No date given.
Peak 1 Manual, The Coleman Company, Inc. 8/1986.
Karcher Manual, pp. I-IX, 21-30, No date given.

*Primary Examiner*—Carl D. Price
*Attorney, Agent, or Firm*—Hamilton, Brook, Smith & Reynolds

[57] ABSTRACT

Diesel fuel is vaporized and then burned on a cylindrical screen flame holder. The fuel is vaporized in a finned, vertical tube vapor generator and directed through a superheater tube past the flame to a flow control valve and nozzle. A flow restriction is provided between a liquid fuel supply and the vapor generator. The flame holder is vertically supported over a mixer and the nozzle. A flame deflector about the flame holder and a reservoir about the nozzle collect fuel condensate during start-up.

15 Claims, 7 Drawing Sheets

VAPORIZING DIESEL BURNER

This invention was made with Government support under DAAK60-87-C-0016 awarded by U.S. Army Natick Research, Development and Engineering Center. The Government has certain rights in the invention.

BACKGROUND OF THE INVENTION

This invention relates to burners which utilize a pressurized supply of fuel and which vaporize the fuel prior to combustion.

Liquid-fueled burners that do not require any external source of power are in common use as portable heat sources for applications such as campstoves and military field kitchens. Generally such burners store the fuel in a pressurized fuel tank and vaporize the liquid fuel prior to combustion in order to provide for complete mixing with combustion air and in order to provide a pressurized gas stream to propel the mixture to the burner head. In the past, most such burners utilized highly volatile fuels such as gasoline or kerosine, since these fuels vaporize at a low temperature, making it easy to heat the vaporizer and maintain the fuel in the vapor state. Operation with less volatile fuels, such as diesel fuel, is far more difficult, since diesel fuel vaporizes at a relatively high temperature, on the order of 600–700 degrees Fahrenheit, making it far more difficult to heat the vaporizer and to deliver the fuel to the burner as a vapor. Moreover, at elevated temperatures liquid fuels tend to decompose, resulting in the formation of carbon and tars which foul the vapor passages. Nonetheless, it is highly desirable to use diesel fuel, since it is much safer than gasoline and is readily available in the military, which uses it as a universal automotive fuel.

Prior-art burners exist that are capable of burning liquid fuels without an external source of power. The vaporized fuel is generally accelerated under pressure in a nozzle, and the resulting fuel vapor jet entrains some or all of the air required for combustion. A common example of this class of burners is the "Coleman Stove", which utilizes a closed fuel tank which is pressurized by pumping air into the fuel tank. The fuel is forced out of the tank by action of the tank pressure and flows through a "generator" in which the fuel is vaporized. The heat necessary for vaporization is provided by a "pre-heat burner" during start-up, and following the pre-heat period, by heat from the main burner. The generator may take many forms, but commonly takes the form of a tube heated on the outside by a preheat burner, and once the main burner is ignited, by the main burner flame. From the generator, the now-vaporized fuel flows through a nozzle in which it accelerates to a high velocity, and then mixes with and entrains air for combustion. The air/fuel mixture then flows to a burner head, which anchors the flame. A fuel valve is generally provided to modulate and/or shut-off the flow of fuel. The fuel valve may control either the liquid fuel or the vaporized fuel.

Other examples of prior-art, non-powered, vaporizing, liquid-fueled burners include:

MSR X/GK campstove (gasoline, kerosine or diesel fuel)

Optimus 199 Ranger (alcohol, gasoline, kerosine)

Coleman Peak 1 (gasoline or kerosine)

Optimus III Hiker (gasoline or kerosine)

U.S. Army M-2 Gasoline Burner Unit (gasoline)

Haas+Sohn V75/1 Type Multicombustible Burner (gasoline, kerosine, diesel fuel)

Karcher Field Kitchen Burner (Gasoline, kerosine, diesel fuel)

The first four prior-art citations are examples of small campstoves, typically under 10,000 BTU/hr output, that may be carried in a back-pack for individual use. The latter three citations are examples of field-kitchen burners having capacities on the order of 60,000 BTU/hr. It is somewhat easier to burn low-volatility fuels in the smaller burners since the entire burner and fuel delivery system may be heated by conduction from the burner head. On account of their larger size, it is more difficult to conduct sufficient heat throughout the larger burners to prevent fuel vapor from condensing in the passages leading from the vaporizer to the burner. The present invention is directed towards solving this problem in larger burners.

Prior-art burners suffer from a number of additional deficiencies which the present invention is intended to overcome. These include:

Slow Start-Up—Many burners, particularly those of larger capacity, are slow-to-start because of the large mass of their vaporizers.

Large Size and Weight—Some burners are heavy and bulky, which is a disadvantage in a burner intended for field use.

Complex and Expensive—Some burners use complex and expensive mechanisms.

Unsafe Operation—Some burners may allow unsafe operation by overheating the fuel tank or burner parts, allowing fuel to drip from the burner, or storing a large volume of vaporized, pressurized fuel.

Unstable Operation—Some burners may operate in a pulsating mode or may be subject to flooding during start-up.

High Maintenance—Most vaporizing burners are subject to fouling of the vapor passages by tars formed by the fuel. This problem is particularly acute in small vapor passages.

Noisy, Dirty Combustion—Many burners produce smoky flames as a result of insufficient combustion air or poor mixing with air or require high air pressure to provide sufficient combustion air, which results in a noisy burner.

DISCLOSURE OF THE INVENTION

In accordance with the present invention, liquid fuel is vaporized and then burned on a flame holder of a burner. A vapor generator comprises at least one vertical tube having fins exposed to a flame on the flame holder. Liquid is vaporized within the vertical tube. A vapor flow control valve is positioned between the vapor generator and the flameholder. Preferably, a liquid flow restrictor is provided between a liquid fuel tank and the vapor generator.

Preferably, the flame holder is a cylindrical screen mounted on a vertically oriented fuel and air mixer over a fuel nozzle. A cup is formed about the nozzle to collect any condensed fuel from the mixer. The mixer is preferably of high thermal conductivity material and is heated by the flame to minimize condensation. A flame deflector surrounds the flame holder and directs the flame upward. The deflector also serves to collect any fuel which condenses at the flame holder during start-up.

A superheater tube carries fuel vapor from the vapor generator past the flame to the fuel nozzle. Preferably, the superheater connects into a strainer and is easily disconnected for cleaning.

By means of the present invention, a burner is capable of burning less volatile liquid fuels without any external source of power. The burner can ignite rapidly from a cold initial state and is ready to operate in a short time. It is compact, lightweight, simple and of inexpensive construction. It is safe and operates in a stable manner under all conditions. Further, it requires little maintenance and operates cleanly and quietly with a low pressure fuel supply.

DESCRIPTION OF THE INVENTION

The principal features of the invention are described in the following figures.

Figure 1:
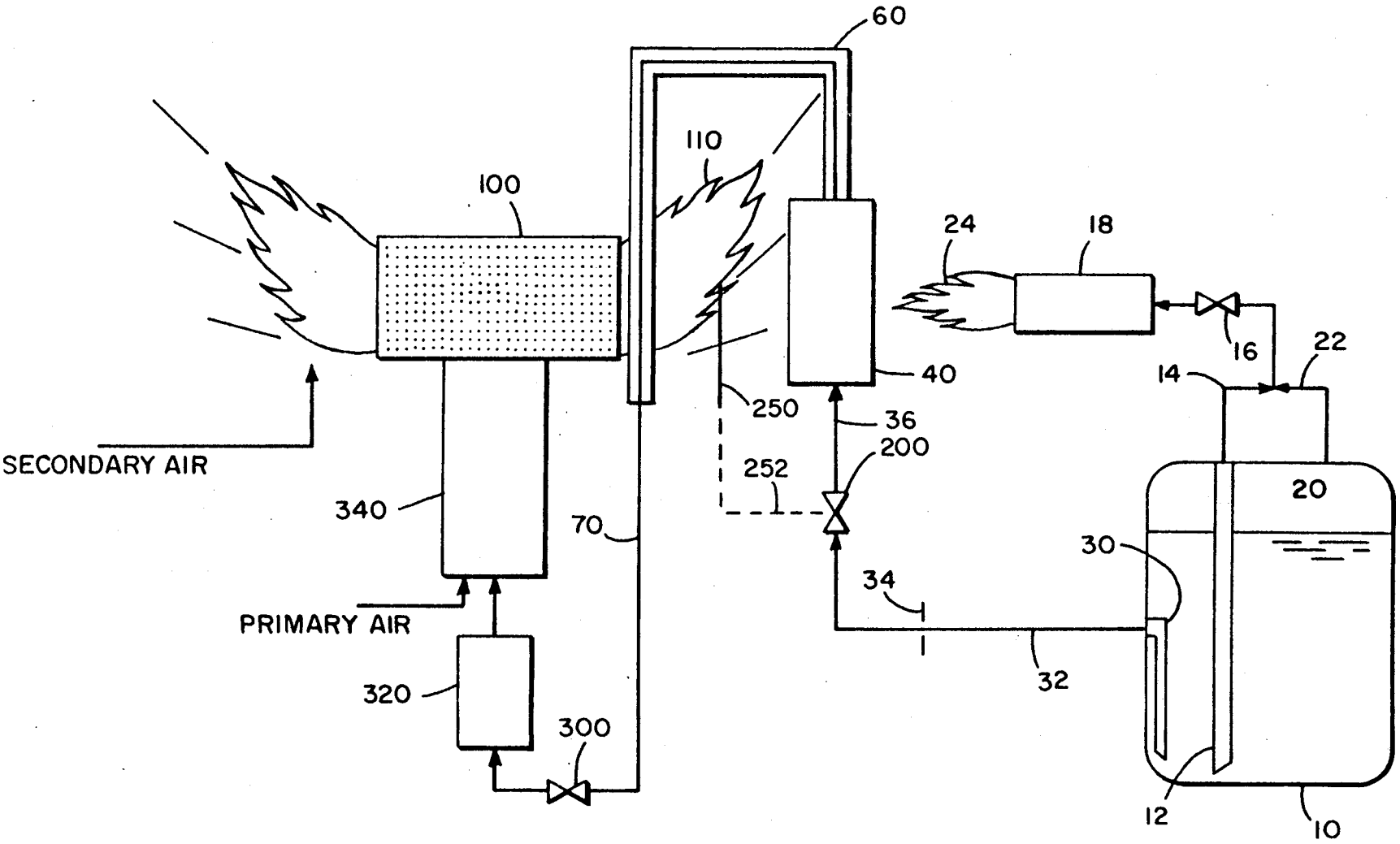
FIG. 1 is a schematic illustration of a vaporizing burner embodying the present invention.

FIG. 1 shows a schematic of the burner system. Fuel storage tank 10 contains dip-tube 12 which draws fuel from the bottom of the tank into preheat torch 18 through conduit 14 and shut-off valve 16. Compressed air is drawn from the top space 20 of fuel tank 10 through conduit 22 to mix with the liquid fuel in torch 18. The flame 24 of the preheat torch 18 heats vapor generator 40 to start the main burner 100. Once the vapor generator 40 has been heated to a sufficient temperature, on the order of 700 degrees Fahrenheit, fuel safety valve 200 is opened, admitting liquid fuel to vapor generator 40. Liquid fuel flows from tank 10 through dip tube 30, through conduit 32 and fuel metering orifice 34 to the fuel safety valve 200. Fuel metering orifice 34 limits the rate of fuel flow so that vapor generator 40 will not become flooded with unvaporized fuel. By thus limiting the rate of liquid flow, fuel can be vaporized at a sufficient rate within vaporizer 40 to build a back-pressure which prevents excessive in-flow.

After the fuel safety valve 200 has been opened, vapor flow control valve 300 is opened. This permits fuel vapor to flow from vapor generator 40 through superheater 60 and conduit 70, through vapor flow control valve 300, and into fuel vapor nozzle 320. The vapor issues from vapor nozzle 320 as a high-velocity jet, entraining primary air into mixer/aspirator 340, which delivers the fuel/air mixture to burner head 100. Once ignited by the preheat burner flame 24, the burner flame 110 heats the vapor generator 40 and superheater 60, which in turn heats the fuel vapor flowing within it to a temperature on the order of 1000 degrees Fahrenheit. This superheating compensates for heat loss by the fuel vapor as it flows through conduit 70, vapor valve 300, and nozzle 320.

In one embodiment, fuel safety valve 200 may be a normally-closed electric solenoid valve powered by a thermocouple 250. To admit fuel to the vapor generator 40, valve 200 is manually kept open until flame 110 or 24 heats thermocouple 250 sufficiently to generate enough power to hold valve 200 in the open position. In the event of a loss of flame for any reason, thermocouple 250 would cool and allow valve 200 to close, thereby shutting-off the fuel flow. This arrangement also permits thermal fuses or thermostatic switches to be placed in series with the thermocouple leads 252 to open the circuit if an unsafe temperature is reached.

Figure 2:
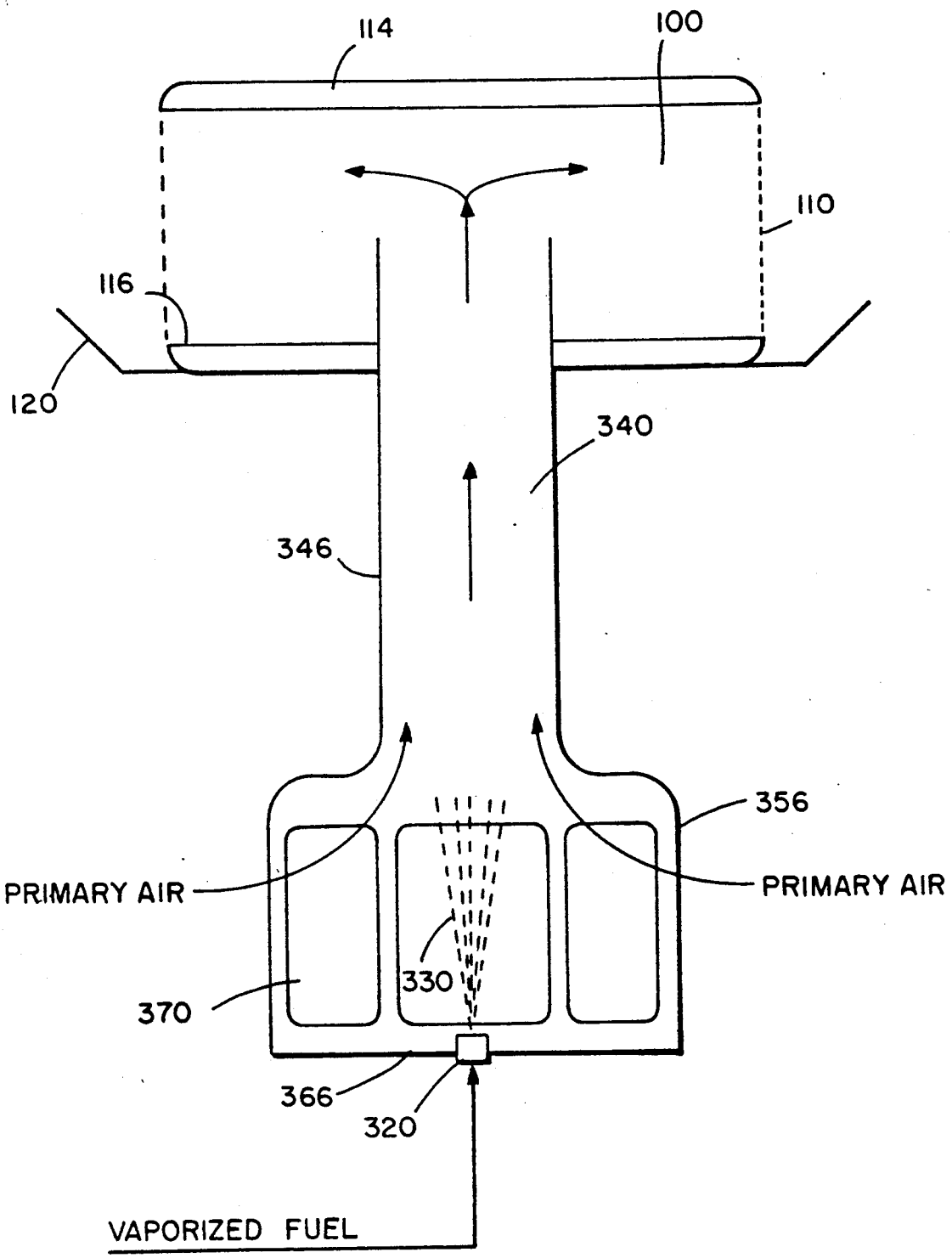
FIG. 2 is a more detailed schematic illustration of the mixer/aspirator of the burner of FIG. 1.

FIG. 2 shows the arrangement of burner 100 and mixer/aspirator 340. Burner head 100 comprises burner screen 110 fitted between top cap 114 and bottom cap 116, and flame deflector 120. Burner screen 110 comprises a cylinder of heat resistant sheet-metal such as stainless steel that is perforated with numerous holes or slots, each having a minor dimension of not more than 0.03 inches and representing an open area of 10% to 20% of the total surface area of the cylinder. Top cap 114 is preferably made of a thin heat-resistant sheet-metal such as stainless steel, and may optionally contain additional burner ports. Bottom cap 116 is preferably constructed of a highly conductive metal such as copper which has been plated with nickel to minimize oxidation. Bottom cap 116 is bonded to mixer tube 346, which preferably is similarly constructed of nickel-plated copper. In the preferred embodiment, heat from the burner flame is conducted by bottom cap 116 and mixer tube 346 down to the inlet 356 of the mixer/aspirator 340. Flame deflector 120 serves to impose a vertically upward component to the primarily radial flow direction of the flame leaving burner screen 110. It also serves to collect any condensation of fuel during startup for subsequent evaporation and burning. Preferably deflector 120 is constructed of heat-resistant sheet-metal such as stainless steel.

Mixer/aspirator 340 comprises mixer tube 346 connected to mixer inlet 356 and fuel vapor nozzle 320. Mixer inlet 356 has an open bellmouth end connected to mixer tube 346 and an opposite flat base 366. The sides of inlet 356 contain openings 370 which admit combustion air to the mixer/aspirator 340. Preferably, openings 370 may be adjusted by a sliding or rotary shutter (not shown). Fuel nozzle 320 is fitted and bonded to a hole centered in base 366 to direct the fuel vapor jet 330 along the centerline of mixer tube 346. The vapor jet 330 entrains and induces combustion air to flow into the mixer inlet openings 370 and along mixer tube 346 into burner 100.

Since mixer/aspirator 340 is heated by conduction from burner 100, once the burner has reached a steady operating temperature fuel does not condense within the mixer/aspirator. During startup, any fuel that does condense within the burner 100 or mixer aspirator 340 is collected within the base 366 of inlet 356. During subsequent operation, that liquid evaporates.

Figure 3:
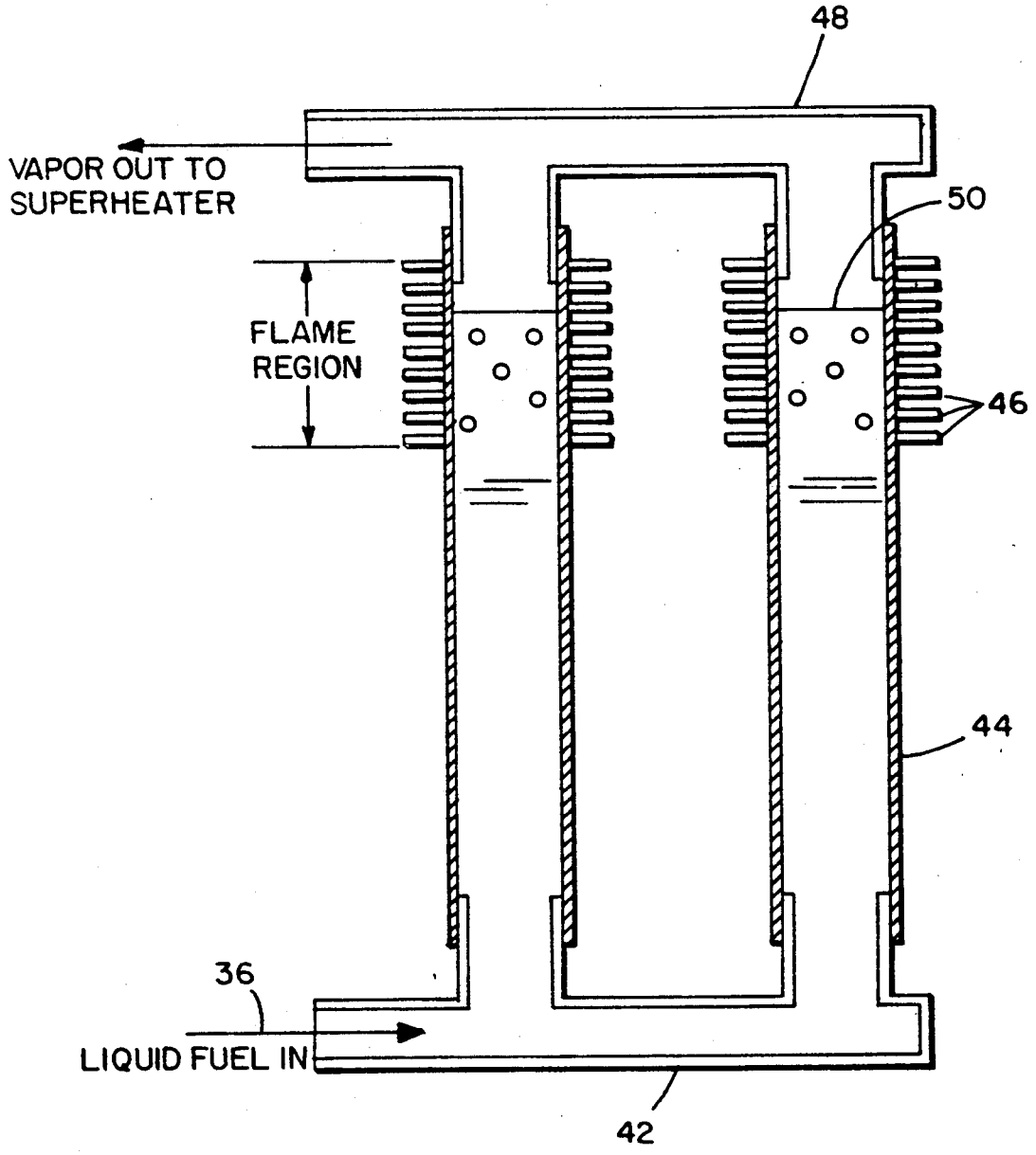
FIG. 3 is a detailed cross-sectional schematic view of the vapor generator of the burner of FIG. 1.

FIG. 3 shows the form of vapor generator 40. Vapor generator 40 is placed between burner head 100 and preheat torch 18 in order that it may be heated by the flame of either. Liquid fuel enters from conduit 36 through inlet manifold 42 which is connected to one or more riser tubes 44. Riser tubes 44 have fins 46 at the top which are positioned to be heated by the flames from both the preheat torch 18 and main burner 100. Vaporized fuel exits from the top(s) of riser tube(s) 44 into outlet manifold 48, from which the fuel vapor then flows into superheater 60 (not shown).

Most of the heating of the fuel occurs within the finned section 46 of riser tube(s) 44. A liquid-vapor interface 50 will normally exist within the finned section 46. Below the liquid-vapor interface 50 liquid fuel is heated to its saturation temperature and caused to vaporize and bubble. Above the interface 50 the fuel is mostly in the vapor state, and as a result of the significantly lower coefficient of heat transfer to the vapor in comparison to the liquid, relatively little heating of the fuel occurs above interface 50.

The elevation of interface 50 within riser 44 is established by a balance between the rate of vaporization and the flow of vapor out of nozzle 320 (not shown, see FIG. 1). If interface 50 is below its equilibrium elevation, less of the interior surface of riser 44 is exposed to liquid, resulting in lower heat input and a correspondingly lower rate of evaporation of fuel. This in turn causes a lower rate of flow through nozzle 320 and vapor valve 300, which results in a lower back-pressure. If the back-pressure is less than the supply pressure established by the pressure in fuel tank 10 (not shown), less any pressure drop caused by flow resistance and elevation change, the flow of liquid fuel into riser 44 will increase, causing interface 50 to rise. This in-turn will increase the surface of liquid being heated, thus increasing the evaporation rate and reestablishing equilibrium.

The rate at which interface 50 will rise or fall in response to a perturbation from equilibrium is governed in part by the resistance of orifice 34 (See FIG. 1). It has been found that a flow resistance sufficient to limit fuel flow to between twice to six times the normal rate of evaporation in the vapor generator 40 will prevent flooding or flow oscillation while permitting good modulation of the burner. Moreover, by limiting the maximum diameter of orifice 34 to 0.020 inches, it acts as a flame arrestor, preventing a flashback of flame from entering the fuel tank.

The use of the vertical vapor generator in combination with the flow-limiting liquid orifice eliminates the problems of flooding and flow oscillations common with other non-powered burners, resulting in a safer, easier-to-operate burner.

Some prior-art generators have sought to solve the problem of flow oscillation by using a small diameter/-volume vapor generator (e.g., ¼ inch internal diameter), which causes the frequency of flow oscillation to increase to a point at which the oscillation may not be objectionable. However, such vapor generators are highly susceptible to fouling by the tars which remain after the lighter fuel fractions have evaporated. Riser(s) 44 preferably have an internal diameter between one-half inch to one inch. Diameters smaller than one-half inch may result in premature failure due to the build-up of tar or carbon, which may block the flow within the vapor generator. Larger diameters result in a larger thermal mass, requiring longer time to preheat the vapor generator.

Figure 4:
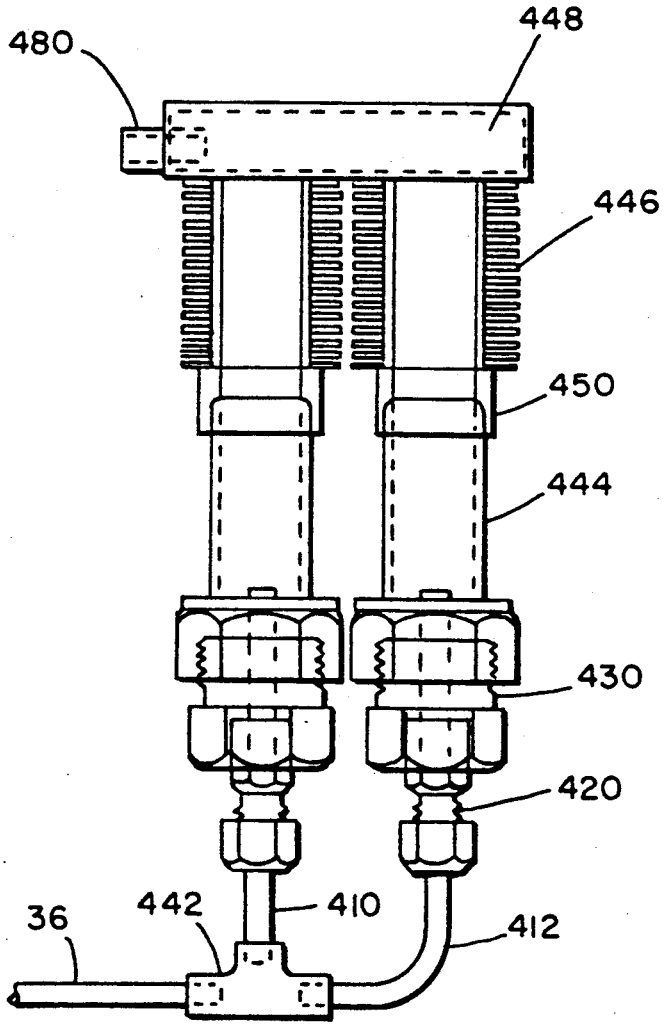
FIG. 4 is a side view of the vapor generator of FIG. 1.

FIG. 4 shows a preferred embodiment of vapor generator 40. Liquid fuel supply tube 36 is joined to inlet manifold tee 442 by soldering, brazing, welding or similar bonding method. Inlet tubes 410 and 412 are also bonded to manifold 442 and extend into riser tubes 444 through compression fittings 420 and 430. Compression fittings 420 are fitted to inlet tubes 410 and 412 and are joined to compression fittings 430, which are fitted to riser tubes 444. Riser tubes 444 are joined to finned tubes 450 having fins 446 by a suitable high-temperature method of bonding, such as "nicro-brazing" or welding. Fins 446 may be machined in tubes 450 or may be stamped out of sheet-metal and brazed to tubes 450. Outlet header 448 may be made out of a closed rectangular tube that is brazed to the top of finned tubes 450 and brazed or welded to the inlet 460 of superheater 60.

This preferred embodiment provides an economical construction which facilitates cleaning of the interior of the vapor generator by unscrewing the compression fittings 420 and 430. Tubing 36, 410 and 412, and fittings 442 and 420 may be constructed of inexpensive low-temperature materials, such as copper or brass, since they are not exposed to high temperature. The remainder of the assembly should be constructed of temperature-resistant materials, such as stainless steel.

Figure 5:
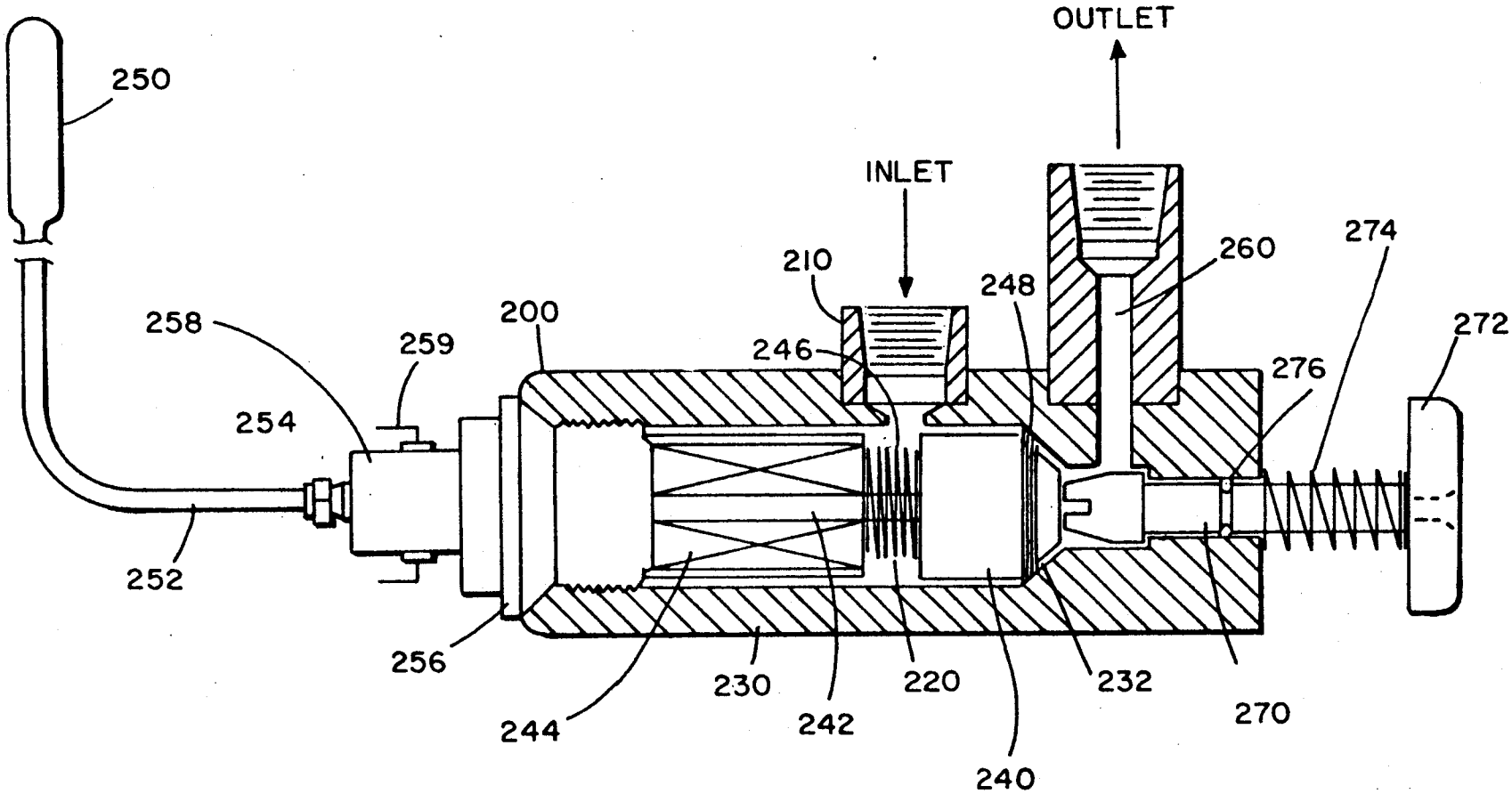
FIG. 5 is a longitudinal-sectional view of a safety valve in the burner of FIG. 1.

FIG. 5 shows a cross-sectional view of fuel safety valve 200. Fuel enters through inlet fitting 210 to inlet plenum 220 within housing 230. Valve plug 240 is fitted to shaft 242 which is surrounded by solenoid winding 244. Spring 246 positioned between solenoid winding 244 and plug 240 forces "O" ring 248 contained in plug 240 against valve seat 232 when the solenoid is deenergized, sealing inlet plenum 230 outlet plenum 260 and outlet fitting 262. Valve plunger 270 is used to manually open valve 200 by pushing on push-button against return spring 274. Plunger "O" ring 276 prevents leakage of fuel between plunger 270 and housing 230. Thermocouple 250 is connected through thermocouple lead 252 and connector 254 and feedthrough 256 to solenoid winding 244. Optional series connector 258 has external terminals 259 which provide connection to an external series loop which may contain thermostatically activated fuses or switches to interrupt the circuit between thermocouple 250 and solenoid winding 244.

In operation, after vapor generator 40 has been heated sufficiently by preheat torch 18, push-button 272 is depressed and held in the depressed position, pushing valve plug 240 away from seat 232 until thermocouple 250 is heated sufficiently by the main burner so that solenoid 244 captures shaft 242 and button 272 may be released. In the event of a flameout, thermocouple 250 will cool, thereby reducing its electrical output, deenergizing solenoid 244 and allowing spring 246 to close plug 240. If any optional thermal switches or fuses are used in combination with optional connector 258, any event which causes them to open will also result in closing of the safety valve.

Figure 6B:
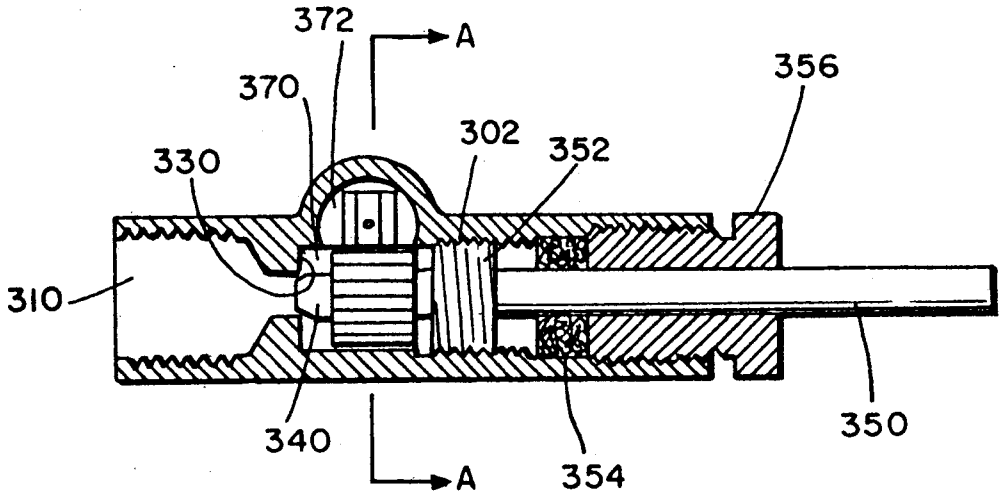
FIG. 6*a* and 6*b* are cross-sectional and longitudinal-sectional views of the flame control valve of the burner of FIG. 1.
Figure 6A:
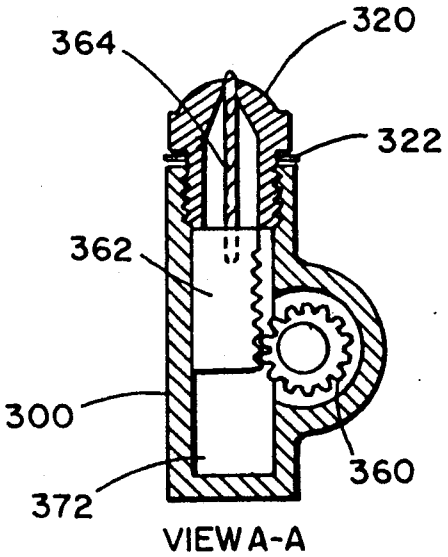

FIGS. 6A and 6B show one form of a combination vapor flow control valve 300 and fuel vapor nozzle 320. Vaporized fuel enters from superheater outlet conduit 70 through valve inlet 310. Valve stem 350 has male threads 352 which engage female threads 302 in valve body 300 to enable valve tip 340 to seal against valve seat 330 in body 300. Valve stem 350 is sealed in body 300 by packing 354 and packing nut 356. Outlet plenum 370 comunicates with chamber 372 into which is screwed vapor nozzle 320, sealed with nozzle gasket 322. Pinion gear 360 is located on valve stem 350 between threads 352 and valve tip 340. Gear 360 engages rack 362 which contains cleanout pin 364. When valve stem 350 is rotated to draw valve tip 340 away from seat 330, gear 360 causes rack 362 to rise. Further opening of the valve causes the cleanout pin 364 in rack 362 to pass through the orifice in vapor nozzle 320, thereby clearing away any debris that may have collected at the orifice.

In a preferred embodiment, cleanout pin 364 may be a twist drill shortened to an appropriate length. The flutes in the twist drill permit vapor to flow through the orifice while the nozzle is being cleaned, thereby permitting the nozzle to be cleaned without extinguishing the main burner.

Additionally, the cleanout pin 364 may be used as a modulating valve, using the nozzle 320 as a secondary valve seat. This can be advantageous when operating the burner at its minimum firing rate, since this causes the nozzle to operate as a variable-area nozzle, maintaining a high vapor velocity through a reduced nozzle cross-sectional area. This results in greater entrainment of air at a given vapor flow rate than if the vapor were throttled by the main vapor flow control valve at seat 330.

Figure 7:
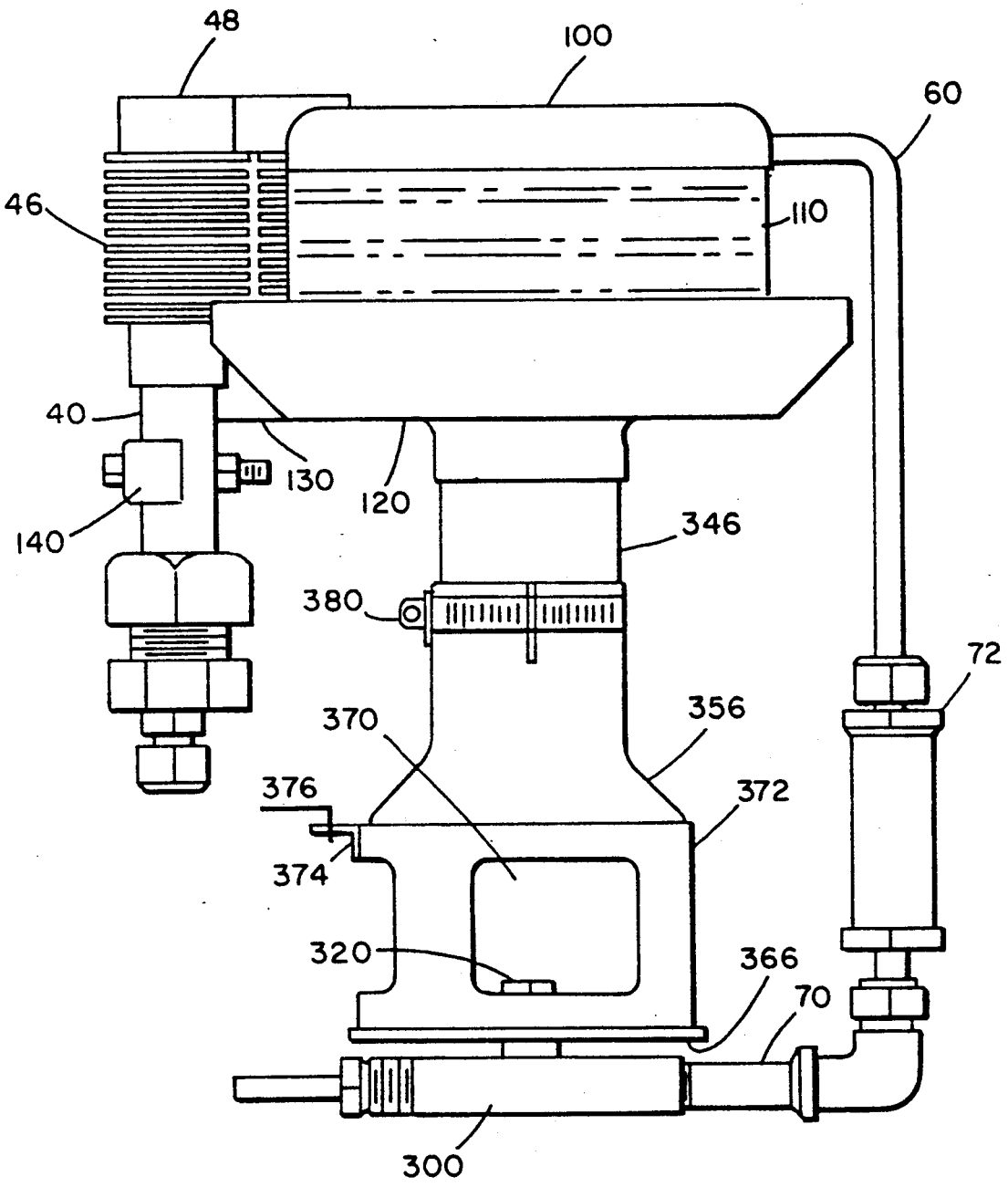
FIG. 7 is a side view of the mixer, flame holder and vapor generator of the system of FIG. 1.

FIG. 7 shows an assembly of the vapor generator, vapor flow control valve and burner/mixer. Vapor generator 40 is attached by clamp 140 to bracket 130 which is bonded to deflector 120 of burner head 100. Fins 46 are positioned to be opposite burner screen 110, and tubular superheater 60 is connected to outlet header 48 and coils about burner screen 110 for approximately 180 degrees before bending downward to the vapor flow control valve 300. The body of valve 300 is fitted and bonded to a hole in the base 366 of mixer inlet 356, securely aligning the nozzle 320 with the centerline of mixer tube 346.

In a preferred embodiment, vapor strainer 72 is positioned between superheater 60 and valve 300 to trap any carbon particles that may have been formed in the vapor generator or superheater and which may clog the vapor valve or vapor nozzle. Superheater tube 60 is readily disconnected from strainer 72 for ease of cleaning. Mixer inlet 356 may also be separably attached to mixer tube 346 and fastened by hose clamp 380. Cable 376 attached to tab 374 on rotary shutter 372 may be used to adjust the position of shutter 372 over air slots 370 to alter the ratio of air to fuel.

We claim:

1. A diesel fuel burner in which liquid fuel is vaporized and burned comprising:

a pressurized liquid fuel supply;

a flame holder which receives vaporized fuel, the flame holder being a cylindrical screen mounted on a vertically disposed mixer over a fuel nozzle, a fuel condensate collector heated through the mixer being formed about the nozzle;

a vapor generator comprising unrestricted vertical tubes having diameters of about ½ inch or greater and having fins exposed to a flame on the flame holder, liquid within finned portions of the tubes being vaporized;

a liquid flow restriction between the liquid fuel supply and the vapor generator;

a superheater tube which carries vapor from the vapor generator past the flame; and a vapor flow control valve between the vapor generator and the flame holder.

2. A burner as claimed in claim 1 wherein the mixer is of high thermal conductivity material and is heated by the flame.

3. A burner as claimed in claim 1 further comprising a flame deflector about the flame holder which serves to collect any fuel condensate from the outside of the flame holder.

4. A burner as claimed in claim 3 wherein the mixer is of high thermal conductivity material and is heated by the flame.

5. A burner as claimed in claim 1 wherein the superheater tube is readily disconnected from the assembly.

6. A burner as claimed in claim 1 further comprising a strainer between the superheater tube and vapor flow control valve for straining the vapor.

7. A diesel fuel burner in which liquid fuel is vaporized and burned comprising:

a cylindrical screen flame holder which receives vaporized fuel, the flame holder being mounted on an elongated vertically disposed mixer over air inlets and a fuel nozzle, the mixer being of high thermal conductivity material and heated by the flame, a fuel condensate collector heated through the mixer being formed abut the nozzle;

a flame deflector about the flame holder which serves to collect any fuel condensate from the outside of the flame holder;

a liquid fuel supply;

a vapor generator comprising at least one unrestricted vertical tube having fins exposed to a flame on the flame holder, liquid from the liquid fuel supply within finned portions of the tube being vaporized within the vertical tube;

a liquid flow restriction between the liquid fuel supply and the vapor generator;

a superheater tube which carries vapor from the vapor generator past the flame; and a vapor flow control valve between the superheater tube and the nozzle.

8. A burner as claimed in claim 7 further comprising a strainer between the superheater tube and vapor flow control valve for straining the vapor.

9. A burner as claimed in claim 8 wherein the superheater tube is readily disconnected from the assembly.

10. A burner as claimed in claim 7 wherein the vapor flow control valve comprises a cleanout pin mounted for reciprocation into and out of the fuel nozzle to clean the fuel nozzle, the pin having helical flutes in the surface thereof to permit continued gas flow during movement of the pin in the fuel nozzle.

11. A gas fired burner as claimed in claim 10 wherein the pin is driven by the drive to a valve member of a flow control valve.

12. A burner as claimed in claim 7 wherein the vapor generator comprises at least two vertical tubes having diameters of about ½ inch or greater.

13. A diesel fuel burner in which liquid fuel is vaporized and burned comprising:

a cylindrical screen flame holder which receives vaporized fuel, the flame holder being mounted on an elongated vertically disposed mixer over air inlets and a fuel nozzle, the mixer being of high thermal conductivity material and heated by the flame, a fuel condensate collector heated through the mixer being formed about the nozzle;

a flame deflector about the flame holder which serves to collect any fuel condensate from the outside of the flame holder;

a liquid fuel supply;

a vapor generator comprising vertical tubes having diameters of about ½ inch or greater and having fins exposed to a flame on the flame holder, liquid from the liquid fuel supply within finned portions of the tubes being vaporized;

a liquid flow restriction between the liquid fuel supply and the vapor generator;

a preheat torch for preheating the vapor generator;

a superheater tube which carries vapor from the vapor generator past the flame, the superheater tube being readily disconnected from the assembly; and a vapor flow control valve between the superheater tube and the nozzle.

14. A diesel fuel burner in which liquid fuel is vaporized and burned comprising:

a pressurized liquid fuel supply;

a flame holder which receives vaporized fuel;

a vapor generator comprising unrestricted vertical tubes having diameters of about ½ inch or greater and having fins exposed to a flame on the flame holder, liquid within finned portions of the tubes being vaporized;

a liquid flow restriction between the liquid fuel supply and the vapor generator;

a superheater tube which carries vapor from the vapor generator past the flame;

a vapor flow control valve between the vapor generator and the flame holder; and a strainer between the superheater tube and vapor flow control valve for straining the vapor.

15. A diesel fuel burner in which liquid fuel is vaporized and burned comprising:

a cylindrical screen flame holder which receives vaporized fuel, the flame holder being mounted on an elongated vertically disposed mixer over air inlets and a fuel nozzle, the mixer being of high thermal conductivity material and heated by the flame, a fuel condensate collector heated through the mixer being formed about the nozzle;

a liquid fuel supply;

a vapor generator comprising at least one unrestricted vertical tube having fins exposed to a flame on the flame holder, liquid from the fuel supply within finned portions of the tube being vaporized within the vertical tube;

a liquid flow restriction between the liquid fuel supply and the vapor generator;

a superheater tube which carries vapor from the vapor generator past the flame;

a vapor flow control valve between the superheater tube and the nozzle; and a strainer between the superheater tube and vapor flow control valve for straining the vapor.

* * * * *